United States Patent [19]

Grossutti

[11] 4,271,547

[45] Jun. 9, 1981

[54] MATTRESS AND BOXSPRING EXTENDER

[76] Inventor: Aldo Grossutti, c/o Algro Investigations Inc., P.O. Box 4704, Vancouver, British Columbia, Canada, V6B 4A4

[21] Appl. No.: 86,241

[22] Filed: Oct. 18, 1979

[51] Int. Cl.[3] ..... A47C 19/00; A61G 7/02

[52] U.S. Cl. ..... 5/181; 5/184; 5/185; 5/479

[58] Field of Search ..... 5/174–176, 5/181, 184, 251, 400, 401, 448, 460, 465, 508, 512, 426

[56] References Cited

U.S. PATENT DOCUMENTS

| | | | |
|---|---|---|---|
| 195,850 | 10/1877 | Shepard | 5/465 |
| 2,271,601 | 6/1942 | Miller | 5/249 |
| 2,879,523 | 11/1956 | Klassen | 5/448 |
| 2,883,683 | 4/1959 | Burk | 5/443 |
| 2,958,874 | 11/1970 | Emery | 5/443 |
| 3,512,191 | 5/1970 | Wall et al. | 5/460 |
| 3,688,321 | 9/1972 | Moss et al. | 5/184 |
| 4,106,138 | 8/1978 | Murphy | 5/184 |

*Primary Examiner*—Casmir A. Nunberg

*Attorney, Agent, or Firm*—Klarquist, Sparkman, Campbell, Leigh, Whinston & Dellett

[57] ABSTRACT

An extender for a bed which has a boxspring, and mattress resting squarely on the boxspring, and a bed frame is provided. An elongated cushion provides an extended sleeping area adjacent a portion of the perimeter of the mattress. An elongated support which is substantially coextensive with the cushion and which may rest on the bed frame, supports the cushion adjacent the portion of the perimeter of the mattress such that extended sleeping area is provided by the cushion. The cushion and the support are connected so as to restrain relative movement therebetween. The extender also has a tongue which extends horizontally outward from the support, which is to be insertably received between the mattress and the boxspring. The opposed ends of the extender are curved so as to conform with the curved corners of the mattress and the boxspring and to allow a number of extenders to be used for providing extended sleeping area adjacent the end and sides of the mattress. An extension apparatus which uses two such extenders on opposite sides of the bed which are interconnected by elastic couplers, is also provided.

11 Claims, 7 Drawing Figures

MATTRESS AND BOXSPRING EXTENDER

BACKGROUND OF THE INVENTION

The present invention relates to extenders to increase the sleeping area of beds.

Extenders for beds have been previously described, however they generally suffer from various disadvantages including one or more of the following:

(1) they are relatively complex in construction;

(2) they are difficult to install;

(3) they tend to slip away from the bed leaving a gap in the sleeping area;

(4) a number of extenders cannot easily be used in combination to substantially enlarge both the width and length of the bed.

An object of the present invention is to provide an extender which is relatively simple in construction and easy to install.

A further object is to provide an extender which may readily be held securely in place against a bed.

A further object is to provide an extender which may readily be used in combination with extenders of the same or similar design to enlarge not only also the length of a bed.

SUMMARY OF THE INVENTION

Extenders or extension apparatus of the present invention are particularly adapted for beds which comprise a boxspring, a mattress resting squarely on the boxspring, and a bed frame. An extender in accordance with the present invention comprises elongated cushion means for providing extending sleeping area adjacent a portion of the perimeter of the mattress and boxspring. The extender also includes elongated support means substantially coextensive with the cushion means for resting on said bed frame and supporting the cushion means in position adjacent the mattress and boxspring such that the extended sleeping area is provided by the cushion means. The cushion means and the support means are connected so as to restrain relative movement therebetween.

Advantageously, the extender includes tongue means for projecting horizontally between the mattress and boxspring from the inward side of the extender. The tongue means assists in holding the inward side of the extender flushly against the mattress and boxspring.

In many cases, the mattress and boxspring will have rounded corners, and the length of the extender will be the same as the length of a side or of an end of the mattress and boxspring. In such cases, the inward side of the extender adjacent the bed may advantageously be curved at opposite ends to conform with the contour of the rounded corners of the mattress and boxspring. In this aspect of the invention, opposite ends of the outward side of the extender may also be advantageously curved, the curvature being substantially the same as the curvature of the opposite ends of the inward side of the extender.

To extend the width of the bed, preferably a pair of extenders as described above, each including a tongue means, is used; the two extenders being positioned on opposed sides of the bed. According to this aspect of the invention, elastic coupling means are advantageously used for elastically connecting the tongue means of one of the extenders with the tongue means of the other of the extenders. Such coupling means assists to hold the inward sides of both extenders flushly against the opposed sides of the mattress and boxspring.

Extenders in accordance with the present invention may be used alone (as on the side or an end of a bed) or in combination (as on both sides or on both sides and one or more ends of a bed) for the purpose of increasing the sleeping area of the bed. In any particular case, the outward side of the extender or extenders may advantageously include means for receiving a tucked edge of a bedsheet.

The invention will now be described in more detail with reference to the drawings in which:

DETAILED DESCRIPTION

Figure 5:
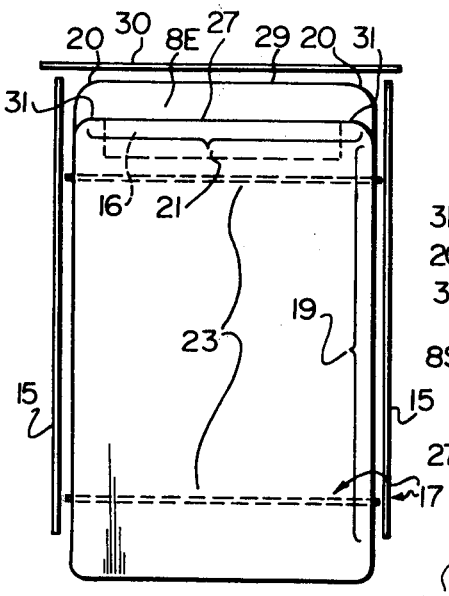
FIG. 5 is a top view of an extender positioned adjacent an end of a mattress and boxspring.
Figure 6:
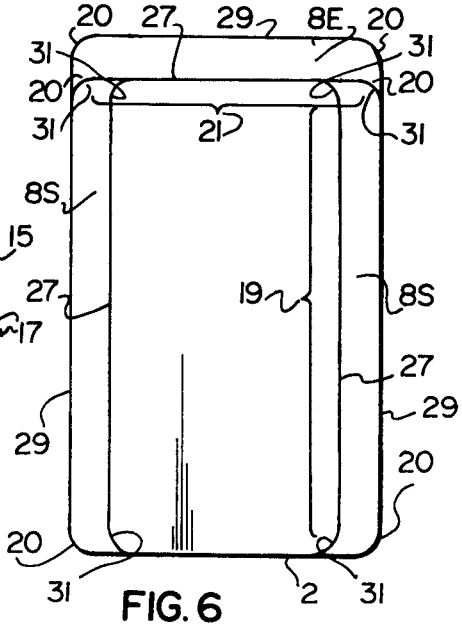
FIG. 6 is a top view of extenders positioned adjacent opposed sides and an end of a mattress and boxspring.

In the drawings, a bed is depicted with an extender or extenders on one side only (FIGS. 1 and 3), two sides only (FIG. 4), one end only (FIG. 5), or on both sides and one end (FIG. 6). The elements of the bed are given the same numeral designations in all Figures. The extenders for the side of the bed are generally designated 8S, and the extender for the end of the bed is generally designated 8E.

The bed has a boxspring 4, a mattress 2 normally resting squarely on boxspring 4, and a bed frame 17. The bed frame 17 has two longitudinal angle irons 15 which face toward an interior of the frame. Brackets 13 are provided on the end of each longitudinal angle iron 15 of the bed frame 17 in order to allow the frame to be fastened to a headboard 30 (shown in FIG. 5 only). Two lateral angle irons 23 extend between the longitudinal angle irons 15 of the bed frame 17. The two lateral angle irons 23 of the bed frame 17 are facing downward. Each of these lateral angle irons 23 consists of two sections which overlap at a segment 25. Each section of a lateral angle iron 23 of the bed frame 17 has corresponding holes 6 through which a bolt can be removably inserted, thereby allowing a lengthening or shortening of the lateral angle iron 23 depending upon the extent of the segment 25.

Figure 1:
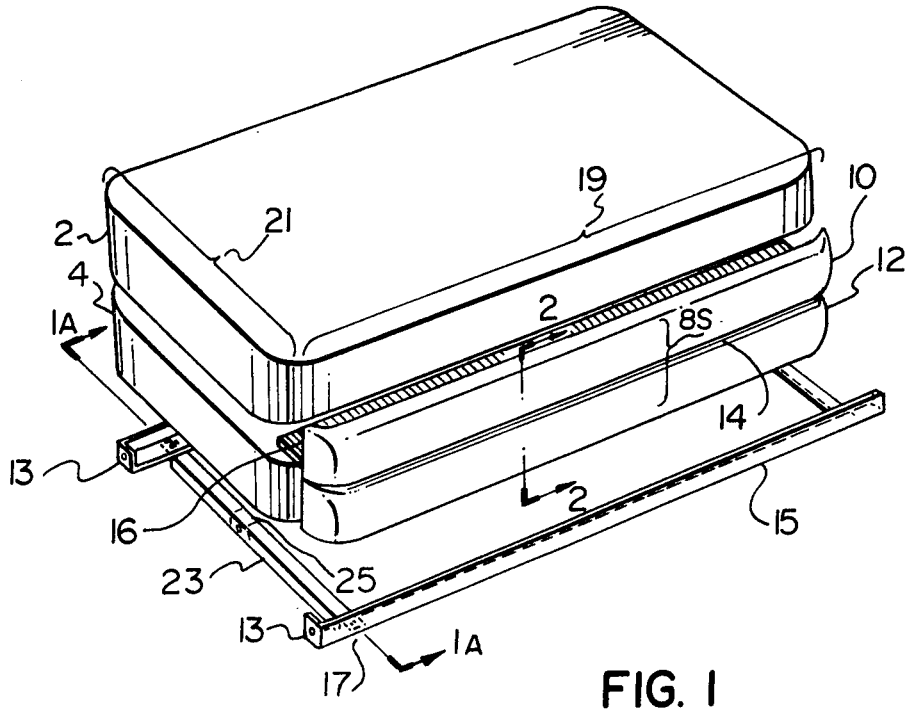
FIG. 1 is an exploded view in perspective of a bed with an extender being used to provide extended sleeping area adjacent a side of a bed which has a boxspring, a mattress and a bed frame.
Figure 2:
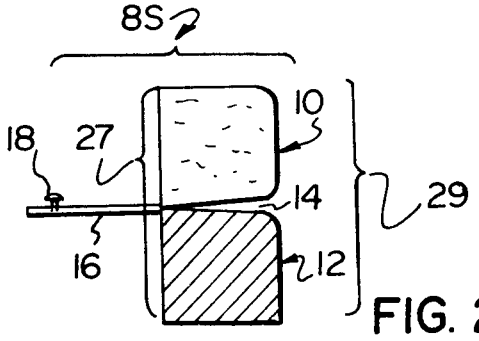
FIG. 2 is a cross-section of an extender taken along the line 2—2 and FIG. 1.
Figure 3:
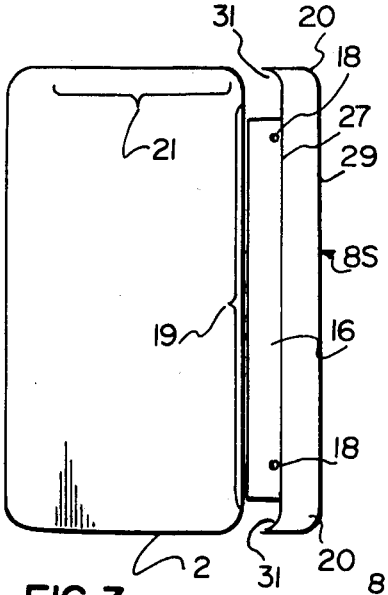
FIG. 3 is a top view of an extender which is about to be positioned adjacent a side of the mattress and boxspring.
Figure 4:
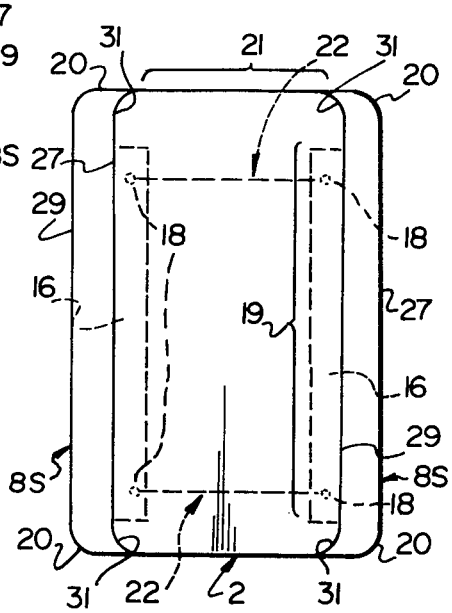
FIG. 4 is a top view of extenders positioned adjacent opposed sides of a mattress and boxspring.

An extender 8S as shown generally in FIGS. 1, 3, 4 and 6, and in cross-section in FIG. 2, has an elongated cushion 10 and an elongated support 12 which is coextensive, and connected to, the cushion 10. Both the cushion 10 and the support 12 of the extender 8S are of substantially rectangular cross-section and are the same thickness as the mattress 2 and the boxspring 4 respectively. The cushion 10 is connected to the support 12 so as to restrain movement therebetween. The cushion 10 and the support 12 each have an inward side and an outward side, the inward sides together forming an inward side 27 of the extender 8S, and the outward sides together forming an outward side 29 of the extender 8S. A tongue 16 is provided for projecting horizontally between the mattress 2 and the boxspring 4 from the inward side 27 of the extender 8S, at a height equal to the thickness of the support 12, and is approximately the same length and width as the extender 8S. The length of the extender 8S is substantially the same length as the length of a side 19 of the mattress 2 and boxspring 4 as is shown clearly in FIG. 1. Opposite ends 31 of the inward side 27 of the extender 8S are curved to conform with the contour of the rounded corners of the mattress 2 and boxspring 4. Opposite ends 20 of the extender 8S have a curvature substantially the same as the curvature of the opposite ends 31 of the inward side 27 of the extender 85. A receptacle 14 is found in an outward side 29 of the extender 8S between the cushion 10 and the support 12, and runs substantially the entire length of the extender 8S. Two studs 18, each of which is sufficiently large to accommodate an end of an elastic coupler 22 may be attached to the tongue 16 of the extender 8S. Studs 18 are only useful when an extension apparatus as shown in FIG. 4 or 6 is assembled. They may be omitted as, for example, when an extender 8S is positioned adjacent only one side 19 of the bed as is shown in FIGS. 1 and 3.

Various materials can be used for cushion 10 and support 12 of extender 8S. Cushion 10 may, for example, be fabricated from foam, or it may be an appropriately formed air bag. Support 12 may, for example, be formed from plastic or wood. It is of course a matter of personal preference just how much cushioning may be provided by cushion 10. If only nominal cushioning is desired, cushion 10 and support 12 may be fabricated from the same material—for example, a foam which compresses relatively little under the weight of a human body. Preferably, tongue 16 is fabricated from plastic, or some other suitable material which is relatively flexible.

FIGS. 5 and 6 show an extender 8E, the length of which is substantially the same length as an end 21 of the mattress 2 and boxspring 5. Apart from length, the construction of extender 8E may be basically the same as the construction of extender 8S described above. Hence, the elements of extender 8E have been given the same numeral designations as the elements of extender 8S.

Figure 1A:
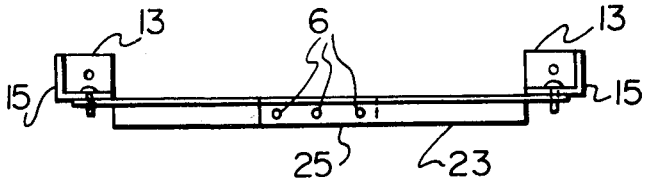
FIG. 1A is a cross-section of the bed frame taken along the line 1A—1A in FIG. 1.

Referring to FIGS. 1, 1A and 3, when an extender 8S is to be used for providing an extended sleeping area adjacent a side 19 of the mattress 2 and the boxspring 4, the mattress 2 and the boxspring 4 are first removed from the bed frame 17. The bolts 6 are removed from the holes of the lateral angle irons 23, and the lateral angle irons extended to a length sufficient for the boxspring 4 and the support 12 to fit snugly between the vertical surfaces of the two longitudinal angle irons 15. The bolts are then reinserted through the holes 6. The boxspring 4 is then placed on the bed frame 17 with one side adjacent a vertical surface of a longitudinal angle iron 15. The support 12 of the extender 8S may then be placed on the bed frame 17, with each of the opposite ends 31 of the inward side 27 of the extender 8S adjacent the curved corners of the boxspring 4 and the mattress 2. The tongue 16 will then rest on a top surface of the boxspring 4. The mattress 2 may then be replaced squarely on the boxspring 4 and in such a position part of the weight of the mattress 2 will be applied against the tongue 16 which is then projecting horizontally between the mattress 2 and the boxspring 4, thereby assisting in holding the inward side 27 of the extender 8S flushly against the mattress 2 and the boxspring 4. In cases where the lateral length to accommodate both the boxspring 4 and the extender 8, it will have to be replaced by an appropriately longer lateral angle iron. The extender 8S will now be flushly against the side 19 of the boxspring 4 and mattress 2, with the outward side 29 flushly against a vertical surface of a longitudinal angle iron 15 of the bed frame 17, and will thereby be restrained from lateral movement away from the bed. Thus the support 12 rests on the bed frame 17 and supports the cushion 10 in position adjacent to the side 19 of the mattress 2 and the boxspring 4 such that extended sleeping area is provided by the cushion 10. An edge of a bedsheet may then be tucked into receptacle 14.

When the sleeping area of a bed is to be extended on both sides, extension apparatus comprising a pair of extenders 8S as shown in FIG. 4 is used. A first one of the extenders 8S extends adjacent one side of mattress 2 and boxspring 4 (the latter of which is not shown in FIG. 4), and a second one of the extenders 8S extends adjacent the opposed side. Two studs 18 are fastened to the tongue 16 of each extender. Coupling means comprising two couplers 22 connect between the tongues 16 of each extender 8S by fastening between opposed studs 18 of the respective extenders 8S. Couplers 22 may be fabricated from elastic webbing or the like to give a desirable elastic characteristic which facilitates ease of assembly.

To add extenders 8S to a bed as shown in FIG. 4, mattress 2 and boxspring 4 are first removed from the bed frame 17, and to a length sufficient for the boxspring 4 and each extender 8 to fit snugly between the vertical surfaces of the two longitudinal angle irons 15. Each extender 8 is then positioned in the same manner as the extender side 19 of the mattress 2, as described above. The elastic couplers 22 are each connected between one of the studs 18 on the first extender and one of the studs 18 on the second extender which is immediately opposite the stud to which the other end of the elastic coupler 22 is connected. The mattress 2 may then be replaced to rest squarely upon the boxspring 4. Thus, the first and second extenders provide extended sleeping area adjacent opposed sides of the mattress 2 and the boxspring 4.

As is shown in FIG. 5, when an extender 8E is to be used for providing an extended sleeping area adjacent to end 21 of the mattress 2, the mattress 2 and the boxspring 4 may be slid or otherwise moved longitudinally along the frame in a direction away from the headboard a distance equal to the width of the extender 8E. The mattress 2 is then removed or slid in a direction further away from the headboard 30. The support 12 of the extender 8E is then positioned so that opposite ends of the outward side of the support 12 are resting on the horizontal surface of each of the two longitudinal angle irons 15 of the bed frame 17. Each of the opposite ends 31 of the inward side 27 of the extender 8E will then be adjacent the curved corners of the boxspring 4 and mattress 2, and the tongue 16 will then rest on a top surface of the boxspring 4. The mattress 2 is then replaced squarely on the boxspring 4 and in such a position part of the weight of the mattress 2 will be applied against the tongue 16 which is then projecting horizontally between the mattress 2 and the boxspring 4, thereby assisting in holding the inward side 27 of the extender 8E flushly against the mattress 2 and boxspring 4. The headboard 30 will then be flushly against the outward side 29 of the extender 8E, thereby restraining lateral movement of the extender 8E away from the bed. In this position the support 12 is held flushly against an end 21 of the boxspring 4 and mattress 2. As well the cushion 2 is held flushly against the end 21 of the mattress 2 and boxspring 4. Thus the support 12 rests on the bed frame 17 and supports the cushion 10 in position adjacent the end 21 of the mattress 2 and boxspring 4 such that extended sleeping area is provided by the cushion 10. In some cases, the longitudinal angle iron 15 of the bed frame 17 may not be sufficiently long to stably support the boxspring 4 and the mattress 2 when the bed is occupied. In such a case, the longitudinal angle irons 15 will have to be replaced with angle irons which are sufficiently long. As well, depending upon the width of the extender 8E which is used adjacent the end 21 of the mattress 2, it may be necessary to reposition the lateral angle irons 23 of the bed frame 17 so that the mattress 2 and the boxspring 4 are stably supported when the bed is occupied.

FIG. 6 shows a configuration where the sleeping area of a bed is extended adjacent both sides and adjacent one end. To obtain this configuration, an extension apparatus, comprising a pair of extenders 8S is first positioned in the same manner as described with reference to FIG. 4. An extender 8E is then placed adjacent the end 21 of the extended mattress and boxspring in the same manner as described with reference to FIG. 5. As the opposite ends 20 of the outward side 29 of extenders 8S have a curvature substantially the same as the curvature of the opposite ends 31 of the inward side 27 of extender 8E, the opposite ends 31 of the inward side 27 of the extender 8E which is placed adjacent end 21 of the mattress 2, will fit snugly against the curved corners of the extended mattress and boxspring. Depending upon the size of the bed frame 17, one or more of the modifications described above may have to be made to the bed frame 17, so that the bed frame 17 will stably support the boxspring 4 and mattress 2 when the bed is occupied.

Various modifications from the specific embodiments described, but within the scope of the following claims, may occur to those skilled in the art.

I claim:

1. An extender for a bed which comprises a boxspring, a mattress resting squarely on said boxspring, and a bed frame, said extender comprising:

(a) elongated cushion means for providing extended sleeping area adjacent a portion of the perimeter of said mattress and boxspring;

(b) elongated support means substantially coextensive with said cushion means for resting on said bed frame and supporting said cushion means in a position adjacent said portion of the perimeter of said mattress and boxspring such that said extended sleeping area is provided by said cushion means;

(c) means connecting said cushion means and said support means for restraining relative movement therebetween; and, (d) tongue means for projecting horizontally between said mattress and boxspring from said inward side of the extender and assisting to hold the inward side of said extender flushly against said mattress and boxspring, said cushion means and said support means each having in inward side and an outward side, said inward sides together forming an inward side of the extender, said outward sides together forming an outward side of the extender.

2. An extender as defined in claim 1, wherein said mattress and boxspring have rounded corners, the length of said extender being substantially the same length as the length of a side of said mattress and boxspring, opposite ends of the inward side of said extender being curved to conform with the contour of said rounded corners.

3. An extender as defined in claim 1, wherein said mattress and boxspring have rounded corners, the length of said extender being substantially the same length as an end of said mattress and boxspring, opposite ends of the inward side of said extender being curved to conform with the contour of said rounded corners.

4. An extender as defined in claim 2 or 3, wherein opposite ends of the outward side of said extender have a curvture substantially the same as the curvature of said opposite ends of the inward side of said extender.

5. An extender as defined in claim 1, 2 or 3, including means in the outward side of said extender for receiving a tucked edge of a bedsheet.

6. Extension apparatus for a bed which comprises a boxspring, a mattress resting squarely on said boxspring, and a bed frame, said extension apparatus comprising:

(a) first and second extenders for providing extended sleeping area adjacent opposed sides of said mattress and boxspring, each of said extenders comprising:

(i) elongated cushion means for providing extended sleeping area adjacent a side of said mattress and boxspring;

(ii) elongated support means substantially coextensive with said cushion means for resting on said bed frame and supporting said cushion means in position adjacent said side of said mattress and boxspring such that said extended sleeping area is provided by said cushion means;

(iii) means connecting said cushion means and said support means for restraining relative movement therebetween, said cushion means and said support means each having an inward side and an outward side, and inward sides together forming an inward side of the extender, said outward sides together forming an outward side of the extender;

(iv) tongue means for projecting horizontally between said mattress and boxspring from the inward side of said extender and assisting in holding the inward side of said extender flushly against said mattress and boxspring; and, (b) coupling means for connecting the tongue means of said first extender with the tongue means of said second extender and assisting to hold the inward sides of said first and second extenders flushly against said opposed sides of said mattress and boxspring.

7. Extension apparatus as defined in claim 6, wherein said coupling means comprises elastic coupling means.

8. Extension apparatus as defined in claim 6, wherein said mattress and boxspring have rounded corners, the length of said extenders being substantially the same length as the length of said opposed sides, opposite ends of the inward side of each extender being curved to conform with the contour of said rounded corners.

9. Extension apparatus as defined in claim 8, wherein opposite ends of the outward side of each extender have a curvature substantially the same as the curvature of said opposite ends of the inward sides of said extenders.

10. Extension apparatus as defined in claim 6, 7, 8 or 9, each extender including means in the outward side of the extender for receiving a tucked edge of a bedsheet.

11. Extension apparatus as defined in claim 6, 7, 8 or 9, including a third extender for extending adjacent an end of said mattress and boxspring from the outward side of said first extender to the outward side of said second extender and thereby providing extended sleeping area adjacent said end, said third extender comprising:

(a) elongated cushion means for providing extended sleeping area adjacent said end of said mattress and boxspring;

(b) elongated support means substantially coextensive with said cushion means for resting on said bed frame and supporting said cushion means in position adjacent said end of said mattress and boxspring such that said extended sleeping area is provided by said cushion means;

(c) means connecting said cushion means and said support means for restraining relative movement therebetween; and, (d) tongue means for projecting horizontally between said mattress and boxspring from an inward side of said third extender and assisting in holding said inward side flushly against said mattress and boxspring.

* * * * *